United States Patent [19]

Futerman

[11] Patent Number: 4,948,265

[45] Date of Patent: Aug. 14, 1990

[54] CONTAINER BAG

[76] Inventor: Charles S. Futerman, c/o 14 Aylmer Parade, London, N2 OPF, United Kingdom

[21] Appl. No.: 318,597

[22] Filed: Mar. 3, 1989

[30] Foreign Application Priority Data

Mar. 4, 1988 [GB] United Kingdom ..... 8805162
Apr. 21, 1988 [GB] United Kingdom ..... 8809403

[51] Int. Cl.[5] ..... B65D 30/04; B65D 33/06

[52] U.S. Cl. ..... 383/6; 383/109; 383/117

[58] Field of Search ..... 383/6, 17, 109, 117

[56] References Cited

U.S. PATENT DOCUMENTS 3,961,655 6/1976 Nattrass et al. ..... 383/109
4,207,937 6/1980 Sandeman et al. ..... 383/17
4,597,102 6/1986 Nattrass ..... 383/117
4,610,028 9/1986 Nattrass ..... 383/17
4,807,299 2/1989 Nattrass et al. ..... 383/109
4,822,179 4/1989 Nattrass ..... 383/117

FOREIGN PATENT DOCUMENTS 1602726 11/1981 United Kingdom ..... 383/17
2148245 5/1985 United Kingdom ..... 383/109

*Primary Examiner*—Stephen P. Garbe
*Attorney, Agent, or Firm*—Darby & Darby

[57] ABSTRACT

A container bag 10 comprises side walls 12 and a base 14 of flexible material. The side walls are provided with lifting loops 18 and have one or more side seams 16. A circular woven inner lining 22 is provided, preferably attached to the bag at the top thereof. The liner absorbs impulsive forces and enables the bag to meet a drop test standard and additionally helps prevent seepage of materials from the bag.

7 Claims, 1 Drawing Sheet

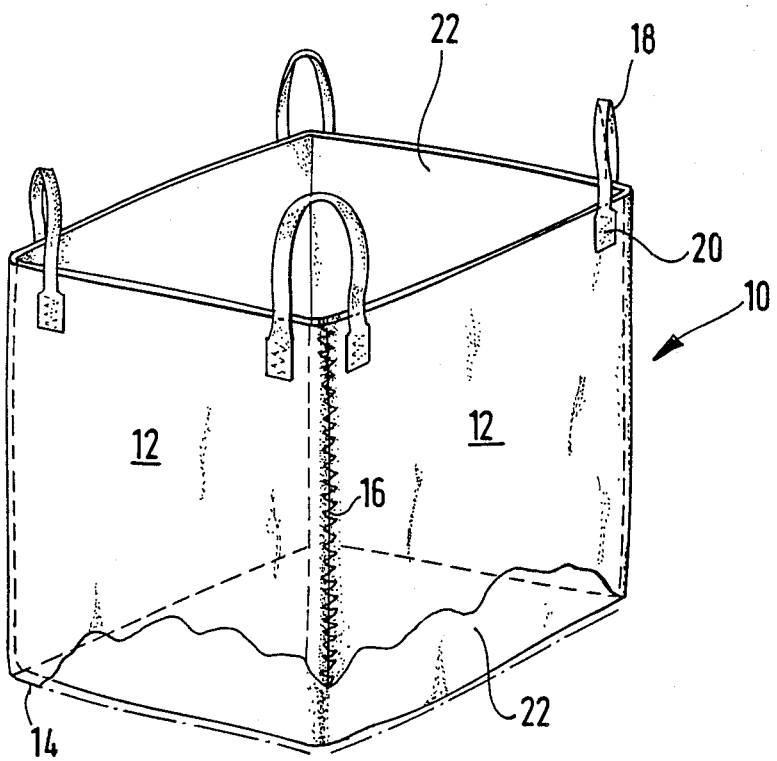
22
18
20
10
12
12
16
14
22

CONTAINER BAG

This invention relates to container bags and in particular relates to container bags for carrying loads in the range of one half to two tonnes and known as intermediate bulk containers (IBC's).

Intermediate bulk containers are increasingly employed in cargo handling and transporting situations, especially for the carriage of particulate or pulverulent material. A typical IBC will be manufactured from a fabric woven from a polyolefin tape and have integral lifting loops. Examples of such containers are described in UK Pat. Nos. 1591091 and 2063816. IBC's have to meet various national and international safety standards; for example, it is normal to require a five to one safety ratio, that is, an IBC rated at one tonne should not break under loads of less than 5 tonnes.

Another requirement which has been introduced, particularly where the IBC is to carry hazardous goods, is the drop test. In this a loaded IBC is dropped from various heights such as 1.2 meters and in order to pass the test the IBC should not burst to cause product spillage under such conditions. The method of manufacturing many IBC's involves one or more side seams and, indeed, in one method of manufacture there are four side seams. IBC's having side seams generally experience difficulty in meeting the more severe drop test requirements. Various proposals have been made to upgrade such IBC's to meet the drop test standards, such as using a special zigzag sewing configuration for the seams which assists in shock absorbtion; overlapping the fabric to permit stretch; and incorporating special additional layers of fabric covering the seams thereby acting as shock absorbers and using much heavier fabric. These methods, whilst effective, considerably slow down the production of the IBC and are expensive both in time and raw material.

Another problem, where fine materials are carried, is prevention of seepage of material through the seams. At present complex procedures for leak-proofing the seams have to be carried out.

The invention seeks to provide an IBC improved in the above respects.

According to the present invention there is provided a container bag which comprises a body of flexible material containing one or more side seams and lifting loops characterised in that the body is provided with a circular woven inner lining.

The use of a liner of a circular woven material enables an IBC to withstand the most severe of the drop tests with ease since the liner absorbs most of the force involved. The liner, being circular woven, has no side seams but has an uninterrupted circular weft which is believed to contribute to its resistance to the forces involved in the drop test. In order that the liner should take the bulk of the forces generated by a drop test, rather than the sides of the IBC proper, it is preferred that the circumference of the liner should be somewhat less than that of the container bag which it is lining.

The liner, having no seams, also serves to reduce or eliminate leakage of fine materials through the IBC side seams. If required solely for the latter use, the circular woven liner can be a relatively light construction. Furthermore, the liner may be extrusion coated.

The liner may be attached to the IBC, e.g., by stitching, or adhesive, or may be unattached. It is preferred that the liner is attached to the IBC, at least at the top edge thereof, since if it is not there is a danger that it will slip down inside the IBC before or during filling. The liner need have no base portion since it is the sides of the bag which are subjected to the greatest forces during a drop test. The use of a liner additionally strengthens the bag in other ways and increases its resistance to spillage, seepage and the like.

The fabric from which the IBC of the invention, and the liner, are formed, may be conventional fabrics for use in this type of container bag and may be woven from polyethylene or polypropylene tape yarns. Preferably, however, at least the side walls of the container bag are made from a fabric having reinforced zones or areas of interwoven reinforcing yarns, for example as disclosed in our UK Pat. No. 1591091. Where such reinforcing areas are provided then they may be as described in that patent and may be formed of interwoven threads of high tensile strength reinforcing yarns such as polyamide, polyester or twisted or fibrillated polypropylene. The lifting loops are attached to such reinforced areas. Alternatively, the IBC may be "underslung" where the lifting loops extend down the side walls and under the base of the container body. In either case the lifting loops will preferably be of a woven webbing of synthetic yarns, for instance of the type used for car seat belts, for example polyamide or polyester yarns, or may be ropes or hawsers of suitable strength.

It is preferred that four lifting loops are provided spaced across the corners of the container bag. The corners will normally be defined by side seams. This construction of bag is particularly preferred since it is roughly cubic in shape when filled and therefore stacks well.

The container bag of the invention may be fitted with a top and/or a filling spout, as well as a discharge spout as is conventional in the IBC art.

The invention will be described further, by way of example, with reference to the accompanying drawings, in which the sole FIGURE is a diagrammatic partially cut-away perspective view of an IBC in accordance with the invention.

Referring to the drawing, an IBC generally designated 10 has side walls 12 and a base 14. The side walls are attached to one another by stitched seams 16. Across each corner is a lifting loop 18 stitched to its respective side wall 12 at 20.

Within the IBC 10 is placed a liner 22 cut from a roll of tubular woven polyethylene or polypropylene cloth so that the liner has no side seams, but is open top and bottom. The circumference of the liner 22 should be slightly less than that of the four sides of the bag 10.

A top may be attached to the bag as is conventional in this field and if so the top of the liner will be attached to the top of the bag walls 12 in the same sewing operation in which the top is attached to the side walls 12. Alternatively, the liner may be separately attached, but this is currently less preferred.

When completed the IBC of the invention may be used in a conventional manner for the storage and transportation of particulate materials. However when subjected to a drop test the performance of the IBC of the invention is considerably better than that of an unlined IBC having side seams in that the bag of the invention passes the drop test whereas the unlined bag does not.

Where the liner is primarily required to prevent leakage, a lighter material may be chosen and the liner may optionally be coated to increase its resistance to seepage. In this case it is not important that the liner material has good tensile strength. The liner should preferably be longer, e.g., about 20 cm longer, than the IBC which will ensure that the base seams are covered without any need to stitch the liner to the base of the bag.

It will be appreciated that the construction of the invention is equally useful where the IBC has two or one side seams used in its method of construction rather than the four side seams illustrated. In each case the drop test performance is improved in accordance with the invention, and seepage of the material reduced or eliminated in a very simple and inexpensive manner.

I claim:

1. A container bag which comprises a body of flexible material containing one or more side seams and being provided with lifting loops comprising a circular woven inner lining disposed within the body, said lining being of sufficient strength and thickness to enhance the strength of the bag.

2. A bag as claimed in claim 1 in which the circumference of the inner lining is somewhat less than that of the container bag.

3. A bag as claimed in claim 1 in which the liner is attached to the container at the top edge thereof.

4. A bag as claimed in claim 1 in which the liner comprises a tubular woven polyethylene or polypropylene cloth.

5. A bag as claimed in claim 1 in which the liner reaches to the bottom of the bag.

6. A bag as claimed in claim 1 in which the liner is longer than the side wall of the bag.

7. A bag as claimed in claim 6 in which the liner is coated to increase its resistance to seepage.

* * * * *